United States Patent [19]

Ailey, Jr. et al.

[11] 4,189,897

[45] Feb. 26, 1980

[54] HIGH SPEED EVACUATION CHAMBER PACKAGING AND CLIPPING MACHINE

[75] Inventors: Harrison A. Ailey, Jr., Knoxville, Tenn.; L. George Andre, Cincinnati, Ohio; Roman M. Tomczak, Raleigh, N.C.

[73] Assignees: Acraloc Corporation; Rheem Manufacturing Company, both of Oak Ridge, Tenn.

[21] Appl. No.: 957,193

[22] Filed: Nov. 1, 1978

[51] Int. Cl.[2] ..... B65B 31/02

[52] U.S. Cl. ..... 53/434; 53/95; 53/101; 53/512; 53/138 A; 53/372

[58] Field of Search ..... 53/434, 512, 86, 89, 53/95, 96, 97, 101, 138 A, 372

[56] References Cited

U.S. PATENT DOCUMENTS

| | | | |
|---|---|---|---|
| 1,052,530 | 2/1913 | Taylor et al. . | |
| 2,154,266 | 4/1939 | Ford . | |
| 2,311,708 | 2/1943 | Sundholm . | |
| 2,780,043 | 2/1957 | Hensgen . | |
| 2,911,008 | 11/1959 | DuBois . | |
| 3,040,777 | 6/1962 | Carson et al. . | |
| 3,082,791 | 3/1963 | Miller . | |
| 3,220,157 | 11/1965 | Buchner . | |
| 3,237,644 | 3/1966 | Beck et al. . | |
| 3,253,616 | 5/1966 | McCorkle et al. . | |
| 3,340,668 | 9/1967 | Bofinger | 53/86 X |
| 3,442,285 | 5/1969 | Faustini . | |
| 3,460,574 | 8/1969 | Risher . | |
| 3,608,866 | 9/1971 | Karpacheva . | |
| 3,625,253 | 12/1971 | Christiansen . | |
| 3,693,314 | 9/1972 | Reid et al. . | |
| 3,702,143 | 11/1972 | Van Wagenen et al. . | |
| 3,713,462 | 1/1973 | Bushee . | |
| 3,722,558 | 3/1973 | Worline . | |
| 3,747,630 | 7/1973 | Hurrell . | |
| 3,795,085 | 3/1974 | Andre et al. . | |
| 3,814,093 | 6/1974 | Gregory . | |
| 3,832,824 | 9/1974 | Burrell . | |
| 3,837,360 | 9/1974 | Bubla . | |
| 3,851,437 | 12/1974 | Waldrop et al. . | |
| 3,856,045 | 12/1974 | Kenny et al. . | |
| 3,868,970 | 3/1975 | Ayers et al. . | |
| 3,940,841 | 3/1976 | Velarde . | |
| 3,958,391 | 5/1976 | Kujubu | 53/434 |
| 4,001,926 | 1/1977 | Velarde . | |
| 4,049,020 | 9/1977 | Neveux . | |

*Primary Examiner*—Travis S. McGehee

*Attorney, Agent, or Firm*—Melville, Strasser, Frost & Jacobs

[57] ABSTRACT

A high speed evacuation chamber packaging and clipping machine for the high speed evacuation and positive sealing of filled, flexible receptacles such as thermoplastic bags in order to preserve the contents of the receptacle. A first endless conveyor carries a plurality of bagged product carrying platens. The first conveyor conducts the platens along a horizontal path of travel with the platens facing upwardly. A second conveyor carries a plurality of hoods. The second conveyor conducts the hoods between and along upper and lower paths of travel and is so located with respect to the first conveyor that when each hood is shifted from its upper path of travel to its lower path of travel, it will engage one of the platens traveling in its horizontal path of travel to form a chamber therewith. Means are provided in association with each chamber for evacuating the chamber. Means are also provided in association with each chamber for applying a clip to the bag to close the bag about the product. Means are provided in association with each chamber to trim the excess of the bag following clipping. Finally, means are provided to devacuate each chamber after the bag has been clipped and trimmed. The second conveyor is so configured that when each hood is shifted from the lower path of travel to the upper path of travel it disengages from its respective platen, exposing the clipped and trimmed bagged product on the platen for further processing.

27 Claims, 27 Drawing Figures

HIGH SPEED EVACUATION CHAMBER PACKAGING AND CLIPPING MACHINE

TECHNICAL FIELD

This invention relates to the evacuation and sealing of filled, flexible receptacles, such as thermoplastic bags, to very low pressure levels in order to preserve the contents of the receptacle. A useful application of the invention is in the packaging of food products such as meat and poultry, cheese and other foods. The storage lifetime is increased by the absence of atmospheric air.

BACKGROUND ART

It is well known to package and store articles, particularly food products, in receptacles in which substantially all of the atmosphere has been removed, and a number of methods are available in the prior art to accomplish this end. In some processes the product is placed in a bag, the mouth of the bag is gathered around the vacuum nozzle while the vacuum acting through the nozzle withdraws the air from the bag, and after evacuation is completed the bag is either clamped shut with a metal clip or heat welded shut. An example of a vacuum nozzle used in this method is shown in U.S. Pat. No. 3,722,558 issued Mar. 27, 1973 to Paul W. Worline. A related automated process utilizing a plurality of vacuum nozzles is disclosed in U.S. Pat. No. 3,795,085 issued on Mar. 5, 1974 to L. George Andre, et al. However, the method utilizing a vacuumizing nozzle has proven to be unsatisfactory because a complete evacuation of the bag is difficult to obtain because the product, such as meat, is usually damp and tends to cling to the bag walls so that surface crevices in the meat will form a pocket with the bag which blocks the passage of air out of the bag during the vacuumizing process.

Other prior art methods for the vacuum packaging of fresh and frozen food products such as beef, poultry, ham, cheese, etc. employ a vacuum chamber into which a filled bag is placed in open condition. The chamber is subsequently evacuated so as to evacuate the bag. The bag is then sealed or closed within the chamber. An apparatus for carrying out such a process is disclosed in U.S. Pat. No. 3,832,824 issued Sept. 3, 1974 to William E. Burrell. However, the immediately foregoing apparatus merely provides a stationary chamber for evacuation of a single package at a time, providing a very slow production rate and high labor cost.

Another prior art method and apparatus for evacuating a filled bag within a vacuum chamber is disclosed in U.S. Pat. No. 3,693,314 issued Sept. 26, 1972 to Philip L. Reid, et al. While Reid, et al attempted to increase the production rate by evacuating two packages at a time and closing and clipping the packages within the evacuation chamber, the cycle time has proven to be extremely long and the production rate still slow.

Another prior art method and apparatus for evacuating a filled bag is the deep draw machine or process. The deep draw machine has, however, proven to be unsatisfactory because it is limited to use with products of constant size, i.e., it is not capable of handling large products in a variety of product sizes, and the closing or sealing of the bags is by way of a heat seal, which does not provide an effective seal.

Still a further prior art method relating to the evacuation and sealing of food products, such as meat and poultry, cheese and other foods, is disclosed in U.S. Pat. No. 3,851,437 issued Dec. 3, 1974 to Thomas E. Waldrop, et al. While the Waldrop, et al. device provides a vacuum chamber within which the product bags are evacuated, it has a major shortcoming in that the products are closed outside of the vacuum chamber. Such procedure is very time consuming and substantially limits the speed at which the product may be packaged.

DISCLOSURE OF THE INVENTION

The present invention provides a high speed evacuation chamber packaging and clipping machine which is capable of obtaining the quality package which other prior art chamber machines obtained but at a far greater speed. The machine may be easily loaded, by hand or automatically, and easily achieve a product production within the range of 35 to 45 pieces per minute.

In its broadest application, the present invention provides a method and apparatus for the high speed evacuation and positive sealing of filled, flexible receptacles such as thermoplastic bags in order to preserve the contents of the receptacle. However, the useful application of the method and apparatus of the present invention is in the packaging of food products such as meat and poultry, cheese, and other foods whose storage lifetime is increased by the absence of atmospheric air. The present method and apparatus will efficiently package such products in a high speed manner.

In its broadest aspects, the high speed evacuation chamber packaging and clipping machine comprises a first endless conveyor carrying a plurality of bagged product carrying platens. The first conveyor conducts the platens along a horizontal path of travel with the platens facing upwardly. A second conveyor carrys a plurality of hoods. The second conveyor conducts the hoods between and along upper and lower paths of travel and is so located with respect to the first conveyor that when each hood is shifted from its upper path of travel to its lower path of travel, it will engage one of the platens traveling in its horizontal path of travel to form a chamber therewith. Means are provided in association with each chamber for evacuating the chamber. Means are also provided in association with each chamber for applying a clip to the bag to close the bag about the product. Furthermore, means are provided in association with each chamber to trim the excess of the bag following clipping. Finally, means are provided to devacuate each chamber after the bag has been clipped and trimmed. The second conveyor is so configured that when each hood is shifted from the lower path of travel to the upper path of travel it disengages from its respective platen, exposing the clipped and trimmed bagged product on the platen for further processing.

The high speed evacuation chamber packaging and clipping machine of the present invention is preferably an in-line machine, which will conserve space and allow it to operate in line with other equipment. This machine combines the benefits of high capacity chamber evacuation with positive seal security. Bag closing, which takes place inside each chamber, is made possible by associating the top section of the clipping and trimming mechanism in the hoods, and the die area in the platens. The aforementioned in-line design of the machine allows the machine to be compact and easily integrated into existing packaging procedures without requiring any costly additional conveyor networks to expedite product flow. It further provides three open sides for product loading, and in operation it is adaptable to being made totally automatic. Furthermore, manual loading is fast and uncomplicated since there is no need to "smooth-out" each bag's sealing surfaces as with heat-seal systems.

The product output of the high speed evacuation chamber packaging and clipping machine of the present invention is substantial and has been found to be at least 30 pieces a minute. This rate may be maintained for all products by simply adding personnel, whenever needed, to speed up platen loading. Once loaded, platens are engaged automatically by a chamber hood. Air is evacuated from the chambers by a manifold vacuum system and the bags are clip-sealed. The excess bag tail is cut-off, and then removed by a vacuum system. The chamber is then vented and the package products are directly released for further processing, such as into a shrink tunnel.

The product versatility of the high speed evacuation chamber packaging and clipping machine of the present invention is a substantial advance in the art. The chamber hoods will accept, without machine adjustments, any size product up to the chamber hood size, regardless of its shape or profile. Smoked meats, small red meat cuts, poultry, cheeses, all vacuum packaged, are ideally suited for the machine of the present invention. The benefits they receive are almost limitless, including superior integrity, use of shorter length bags, minimum maintenance, high level vacuuming without excessive product moisture, which is the plaque of deep-draw systems, lasting reliability and peak operating performance, and a tough water-tight metal clip positive seal unaffected by contaminated sealing surface, or varying bag sizes or thicknesses as heat seals are.

The high speed evacuation chamber packaging and clipping machine of the present invention provides operating advantages that produce important savings through increased efficiency, broad product versatility, and improved package protection for extended product shelf life.

DESCRIPTION OF THE DRAWINGS

FIG. 6 is a view, partially in section, through a clip feed magazine.

DETAILED DESCRIPTION OF THE INVENTION

Figure 1:
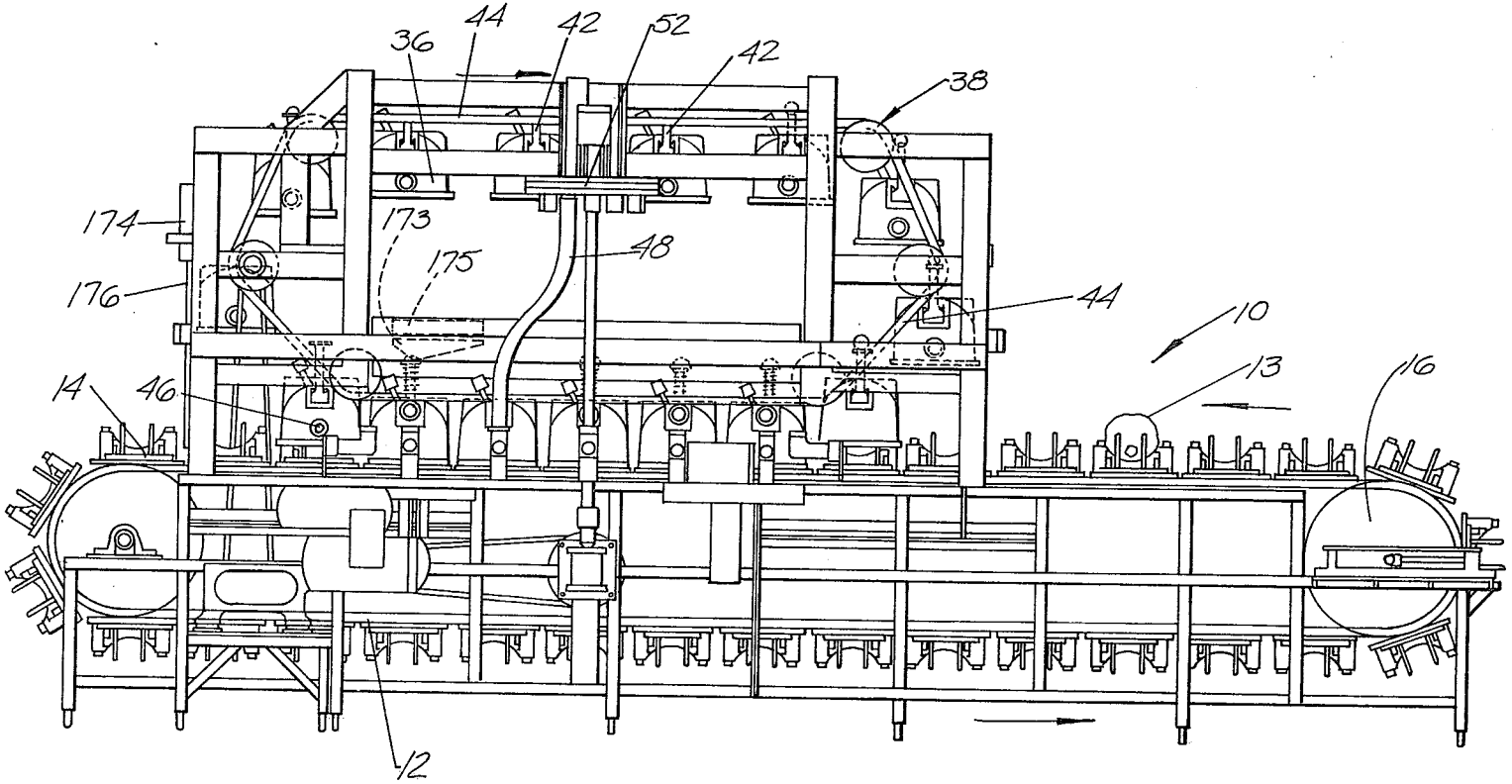
FIG. 1 is a rear side elevational view of the high speed evacuation chamber packaging and clipping machine of the present invention.
Figure 2:
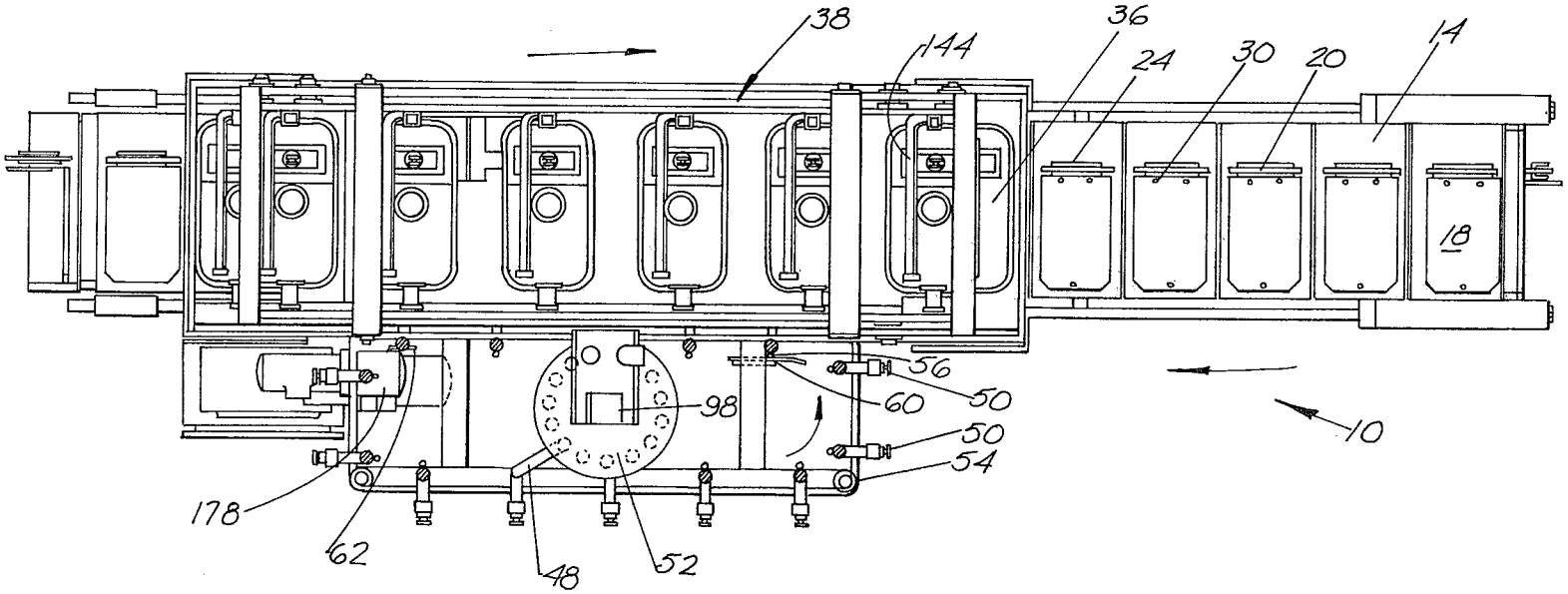
FIG. 2 is a plan view showing the high speed evacuation chamber packaging and clipping machine of the present invention.
Figure 3B:
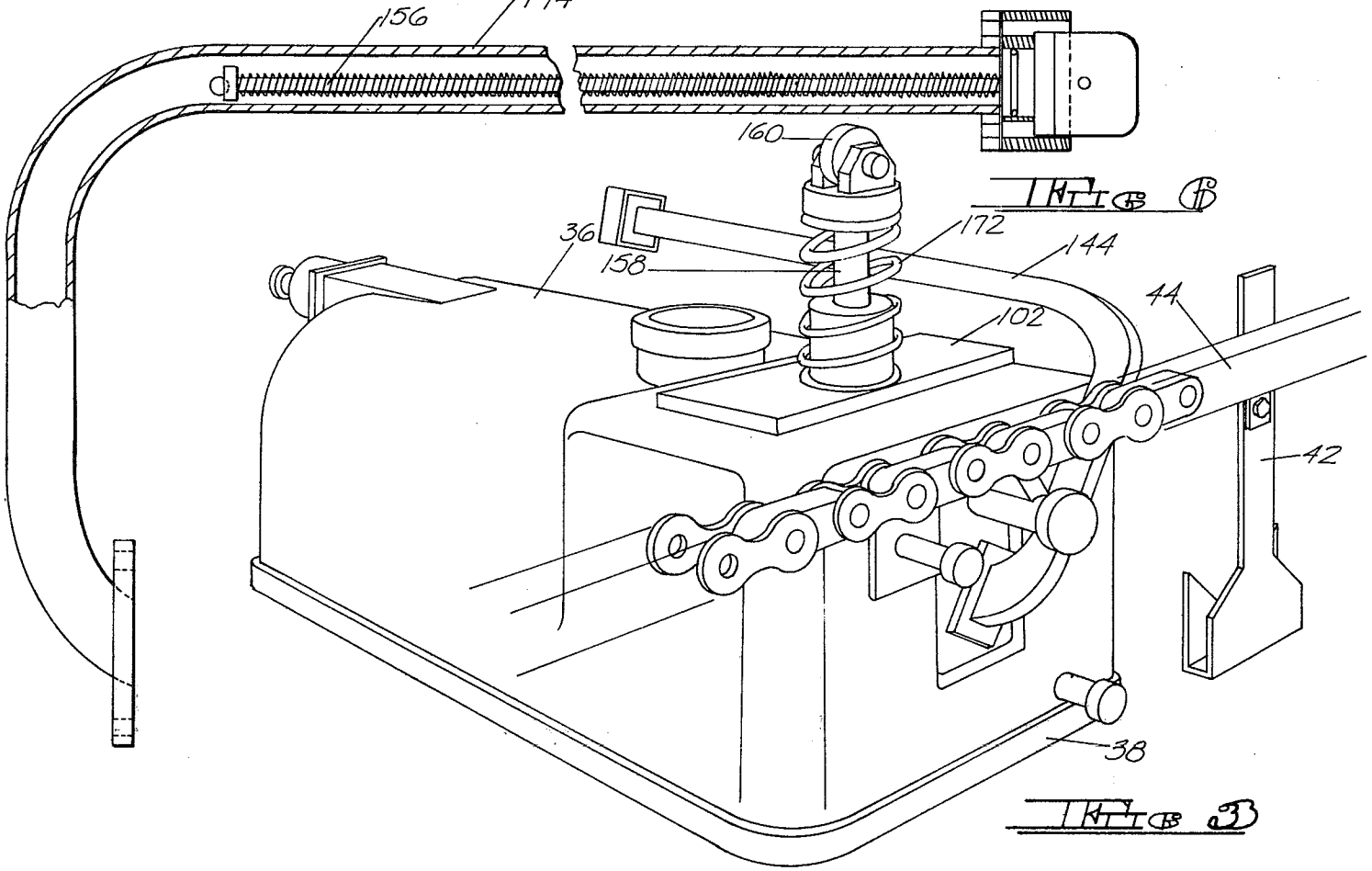
FIG. 3 is a perspective view, partially exploded, showing a hood with an associated hood hanger and hood supporting trolley and associated clipping and trimming mechanism.
Figure 4A:
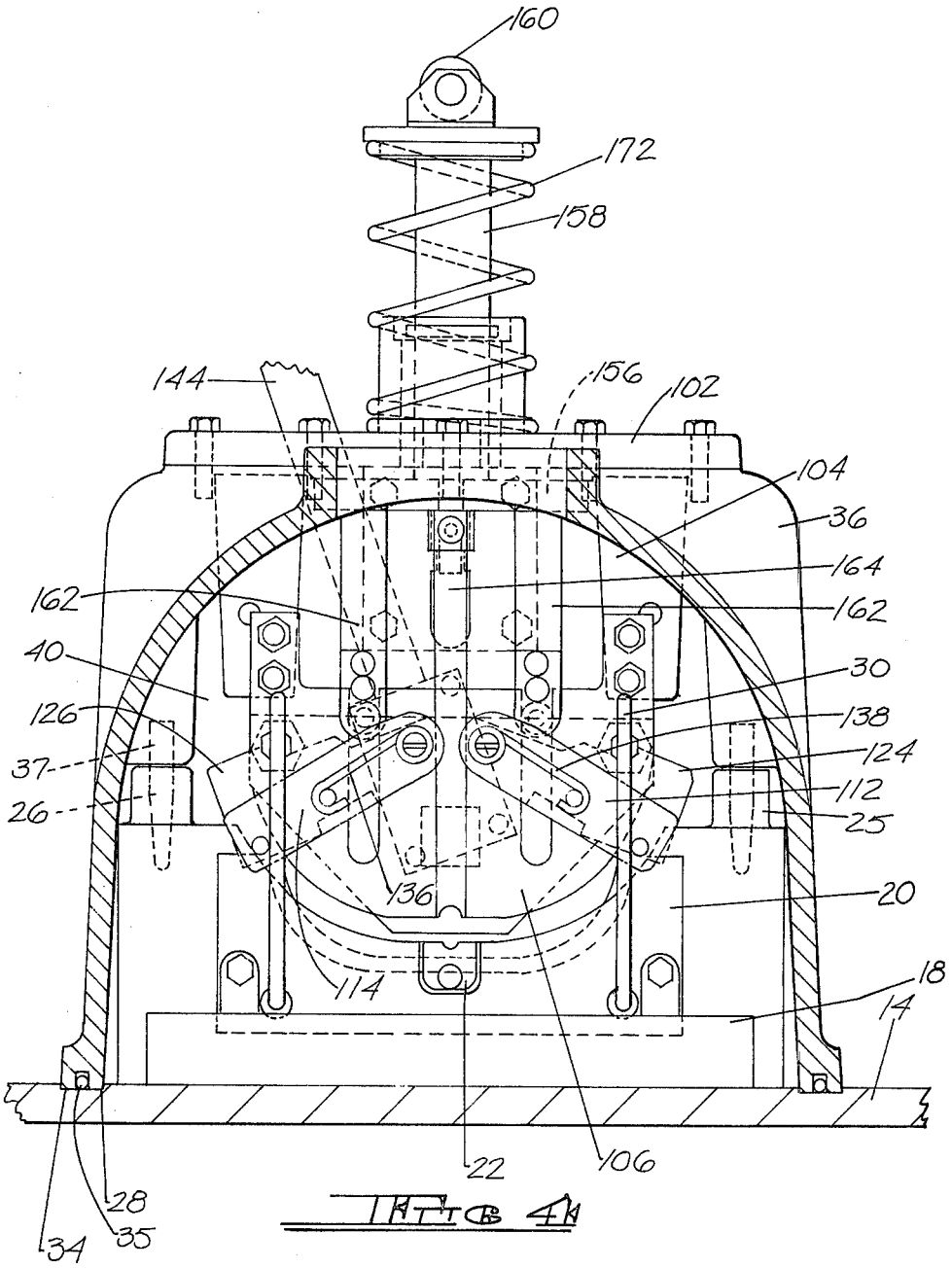
FIG. 4 is a view, partially in vertical section, through a chamber formed by a mating hood and platen showing the clipping and trimming mechanism in the hood and the die area in the platen.
Figure 5:
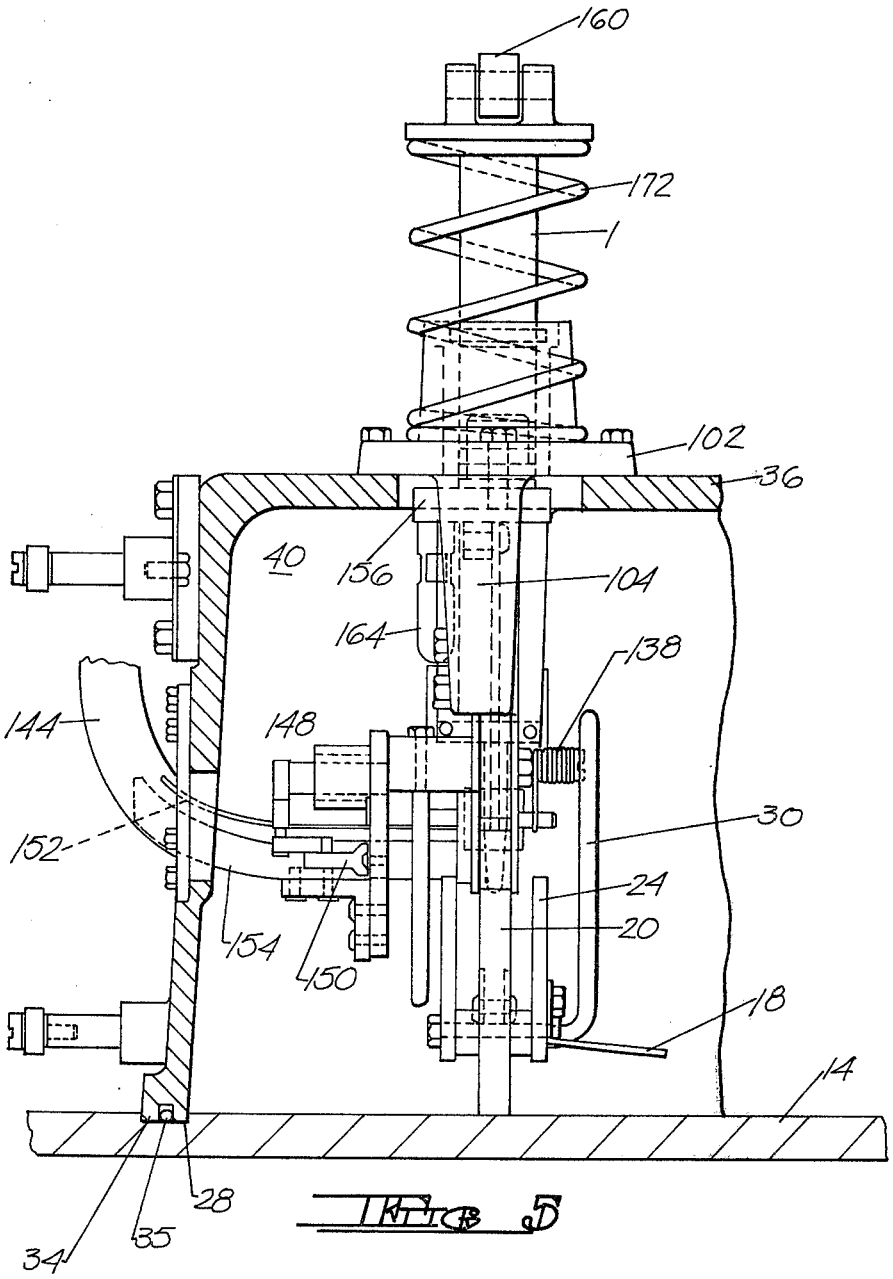
FIG. 5 is a view similar to FIG. 4, partially in section, showing a side elevational view of the clipping and trimming mechanism within a chamber formed by a hood and mating platen.

Referring to the drawings, and in particular to FIGS. 1 and 2, the high speed evacuation chamber packaging and clipping machine 10 of the present invention will be described in terms of an in-line machine, which is compact and easily integrates into existing packaging procedures without requiring any costly additional conveyor networks to expedite product flow. However, it will, of course, be understood that the machine 10 of the present invention is not limited to an in-line machine.

The machine 10 of the present invention includes a first endless conveyor 12 carrying a plurality of bagged product carrying platens 14. The first conveyor 12 conducts the platens 14 along a horizontal path of travel with the platens 14 facing upwardly. As can be seen the first endless conveyor 12 passes about a pair of spaced sets of sprockets 16 having horizontal axes, whereby to have upper and lower flights the upper flight thereof comprising the horizontal path of travel.

Figure 7:
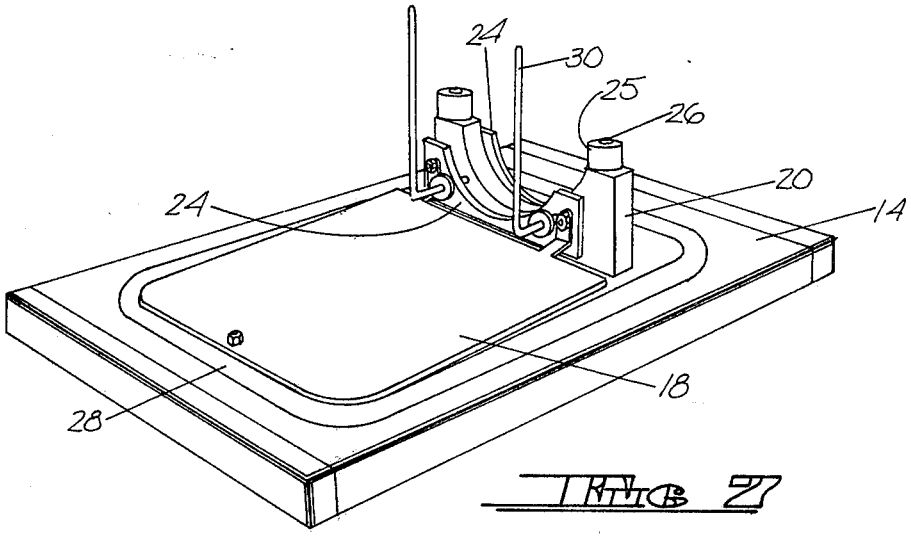
FIG. 7 is a perspective view of a bagged product carrying platen.
Figure 8:
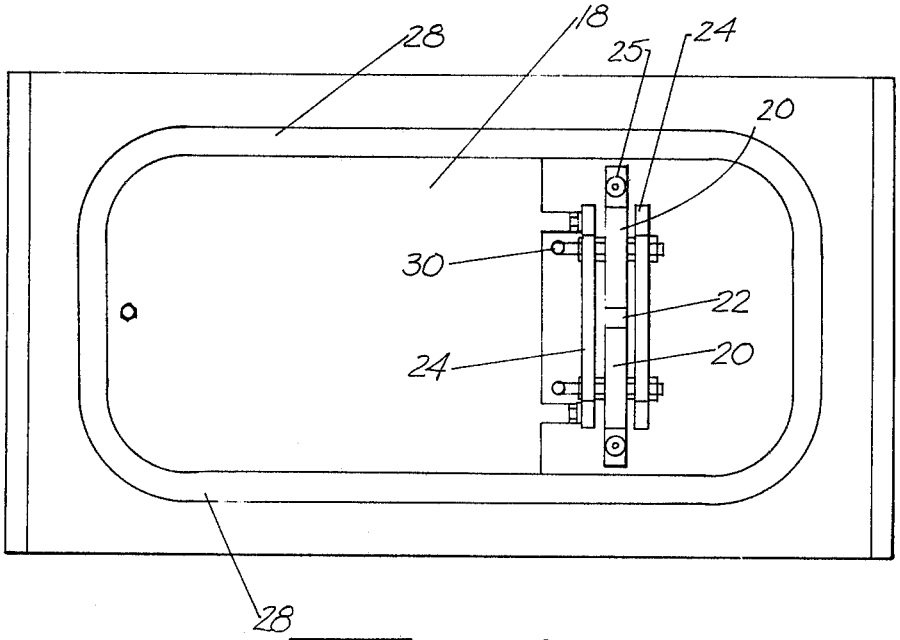
FIG. 8 is a plan view of a bagged product carrying platen.

Each of the platens 14, as best seen in FIGS. 7 and 8, includes a product tray 18, which may be adjusted to raise small products to the proper height for clipping and trimming, on which the bagged product 13 is placed automatically or manually by an operator. An upstanding die holder 20 supporting a peripheral die 22 is positioned adjacent one end of the product tray 18. Hood guides 25 having central apertures 26 are positioned on the upstanding die holder 20. Bag restrainer plates 24 are positioned at either side of the upstanding die holder 20. Bag restrainers 30, which are positioned on either side of the upstanding die holder 20, extend upwardly from one of the bag restrainer plates 24. A suitable recessed area 28 may be provided on the surface of the platen 14 to receive the underside 34 of a hood 36, which may be provided with an appropriate seal member 35.

A second conveyor 38 carries a plurality of hoods 36 and conducts the hoods 36 between and along upper and lower paths of travel. The second conveyor 38 is so located with respect to the first conveyor 12 that when each hood 36 is shifted from its upper path of travel to its lower path of travel it will engage the recessed area 28 of one of the platens 14 traveling in its horizontal path of travel to form a chamber 40 therewith. Guide pins 37 within the hood 36 mate with the apertures 26 of the hood guides 25 so as to properly center lock hood 36 with respect to its mating platen 14. The second endless conveyor 38 may comprise a plurality of hood supporting trolleys 42 traveling along a track 44 having a substantially oval configuration in the vertical plane so as to conduct the hoods 36 along upper and lower flights, with the lower flight constituting the lower path of travel and the upper flight constituting the upper path of travel.

Figure 10:
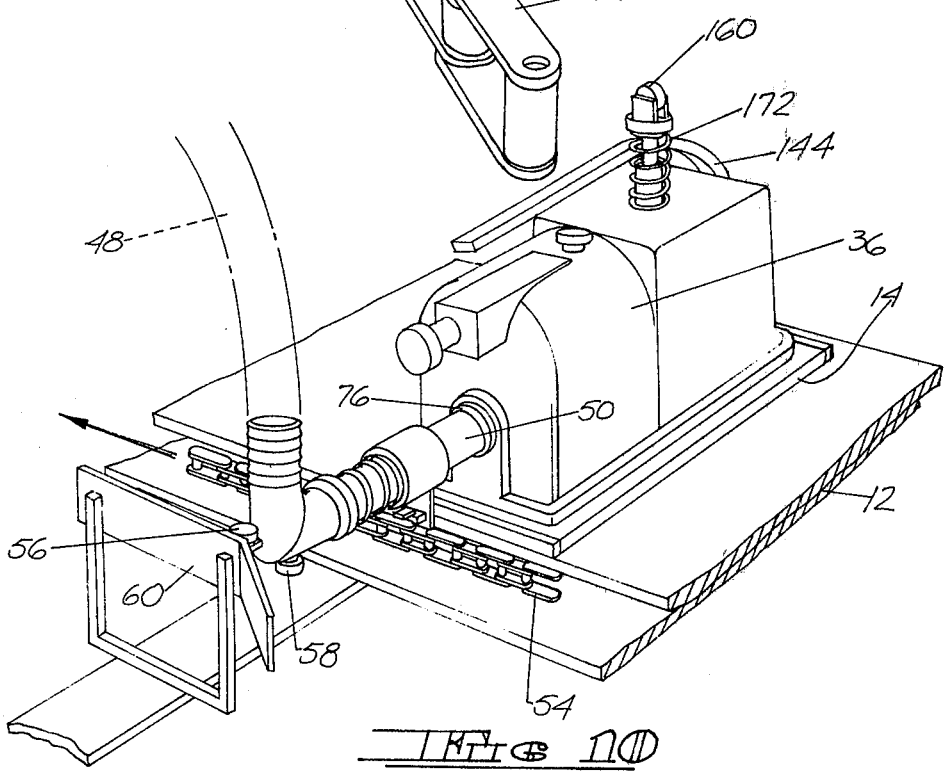
FIG. 10 is a fragmentary perspective view showing a single hood and its respective mating platen with the free end and nozzle of its respective vacuum hose as the nozzle is inserted into the hood vacuum port.
Figure 11:
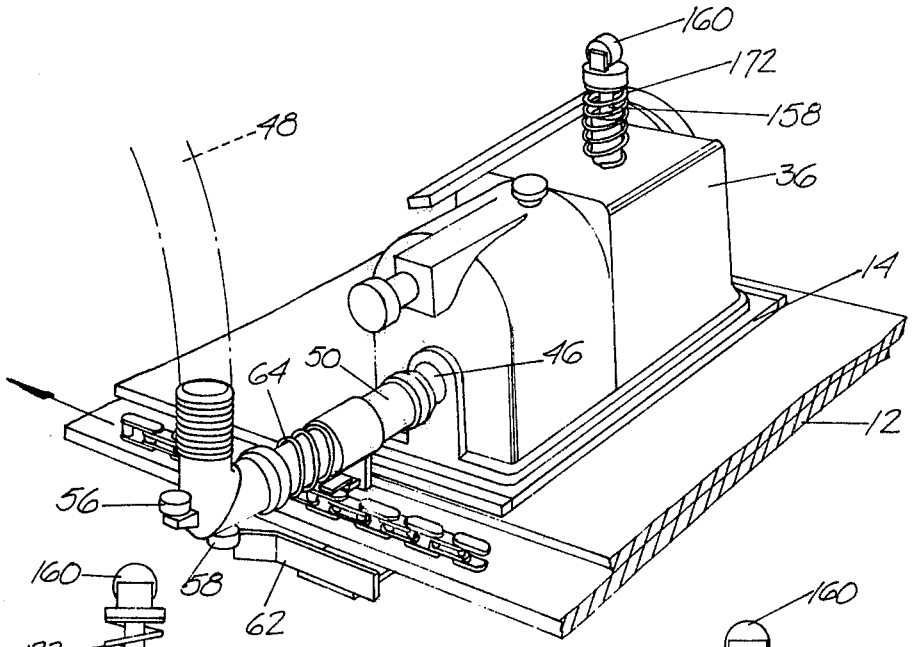
FIG. 11 is a view similar to FIG. 10 showing the removal of the vacuum hose nozzle from the hood vacuum port prior to the lifting of or removal of the hood from its respective platen.

Means are provided in association with each of the chambers 40, formed by a hood 36 and its respective platen 14, for evacuating the chambers 40. As seen in FIGS. 10 and 11, the means for evacuating the chambers 40 includes a vacuum port 46 on the hood 36 of each chamber 40. A vacuum hose 48 is provided for each chamber 40, each hose 48 having a free end provided with a nozzle 50 for engagement with the vacuum port 46. The other end of each hose 48 is connected to a vacuum manifold 52 connected to a vacuum source.

Figure 9:
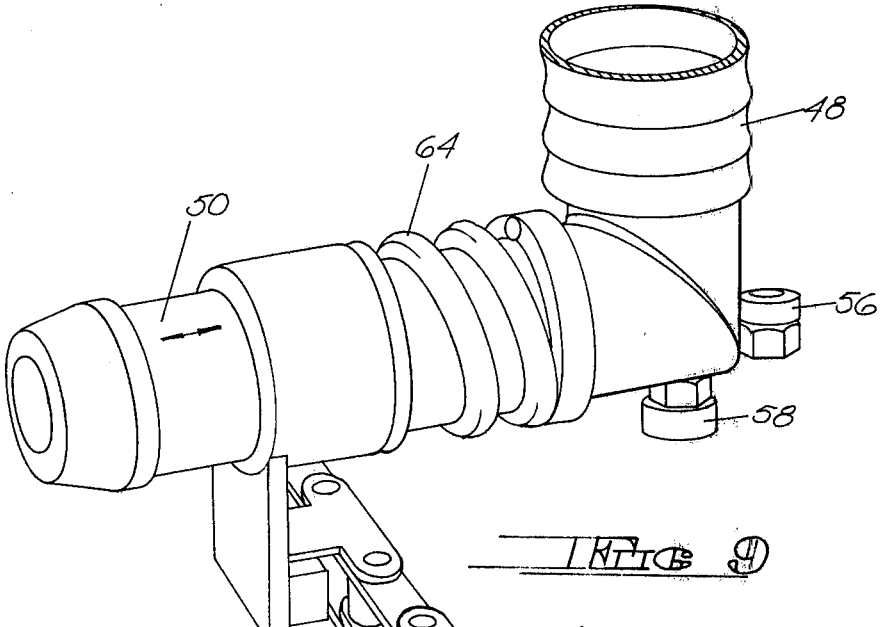
FIG. 9 is a perspective view of the free end of a vacuum hose and its associated guiding sprocket.

Means are provided for inserting the nozzle 50 of each hose 48 in its respective hood vacuum port 46 when the hood 36 forms a chamber 40 with one of the platens 14. In practice this is accomplished by way of a third endless conveyor 54 which conducts the nozzles 50 on the free ends of the hoses 48 along a horizontal path of travel adjacent the horizontal path of travel of the chambers 40 formed by the mating hoods 36 and platens 14, as best seen in FIGS. 2, 9, 10 and 11. During operation the platens 14 move continuously in a counter clockwise position, as seen in FIGS. 1 and 2, while the hoods 36 move continuously in a clockwise rotation and the nozzles 50 rotate in a counter clockwise rotation, also as seen from FIG. 2. As a nozzle 50 approaches the horizontal path of travel adjacent the horizontal path of travel of the platens 14, the camming element 56 is directed against the cam track 60 and the nozzle 50 is cammed forwardly and inserted into the vacuum port 46 of the hood 36, as best seen in FIGS. 9 and 10. The cam track 60 is of such a length that it maintains each nozzle 50 securely in position in its respective hood vacuum port 46 until a primary vacuum is drawn through the hose 48 so as to evacuate the chamber 40. The vacuum within the chamber 40 thereupon causes the nozzle 50 to be retained in the port 46.

Means are also provided to remove each nozzle 50 from its respective hood vacuum port 46 after the bagged product 13 has been clipped and trimmed but prior to the lifting of or removal of the hood 36 from its respective platen 14. This is accomplished by way of the nozzle cam element 58 which is directed against the cam track 62, pulling the nozzle 50 away from the port 46, as best seen in FIG. 11. This action is also aided by the spring member 64.

Figure 12:
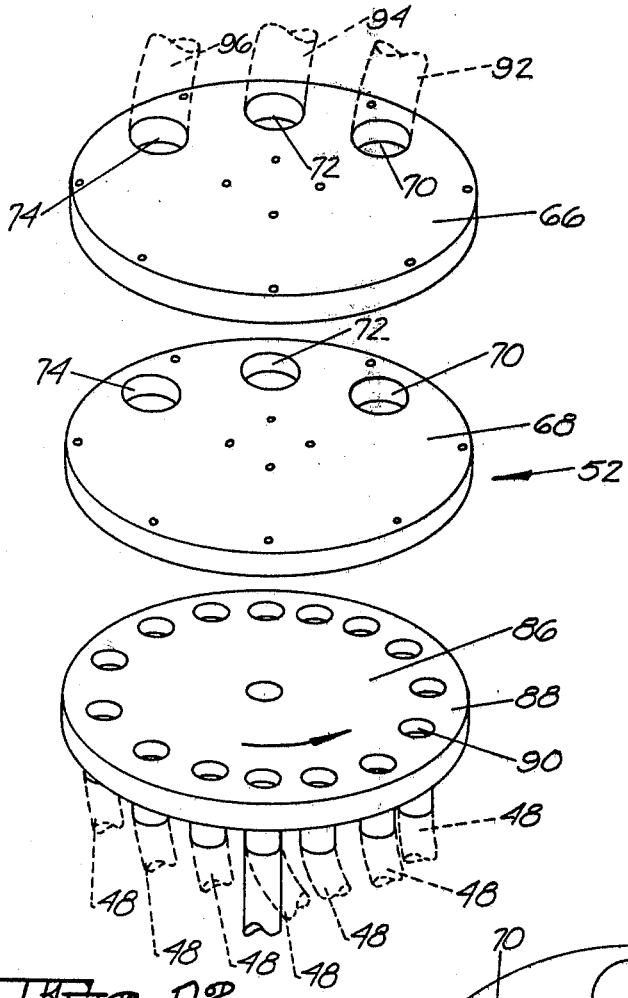
FIG. 12 is an exploded perspective view of the vacuum manifold.
Figure 13:
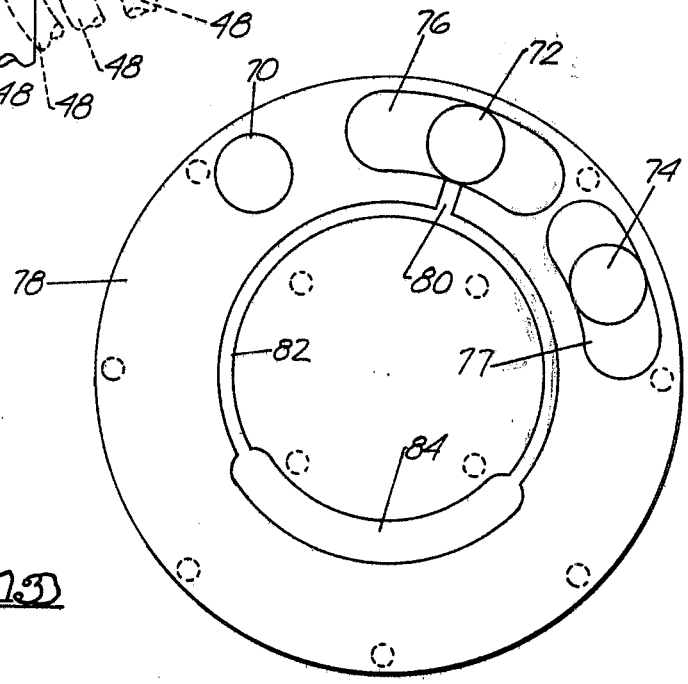
FIG. 13 is a bottom plan view of the facing seal member of the vacuum manifold.

The vacuum manifold 52 comprises a fixed plate 66 faced with a high strength thermoplastic resin seal member 68 such as that sold under the registered trademark Delrin by E. I. duPont de Nemours & Co. It will, of course, be understood that the seal member 68 may be made of any other synthetic resin material having the characteristics of high strength and stiffness combined with toughness and resilience over a wide temperature range, good dimensional stability in the presence of moisture, high heat distortion temperature, excellent bearing characteristic, and good abrasion provided through the stationary plate 66 and facing seal member 68. The centers of the holes 70, 72 and 74 are located equidistant from the center of the stationary plate 66. The circular aperture 72 communicates directly with an elongated arcuate cavity 76 formed in the bottom surface 78 of the seal member 68. Similarly, the circular aperture 74 communicates directly with an elongated arcuate cavity 77 formed in the bottom surface 78 of the seal member 68. The cavity 76 is connected by a groove or passage 80 to an annular cavity 82 formed in the bottom 78 of the seal member 68 and having an enlarged portion 84. The sole purpose of the groove or passage 80, annular cavity 82 and its enlarged portion 84 is to balance the forces between the face 78 of the seal member 68 and the face 86 of the rotating plate 88 to be described hereinafter. The rotating plate 88 is provided with a plurality of apertures 90 therethrough corresponding in number to the number of vacuum hoses 48. Each of the apertures 90 is equidistant from the center of the rotating plate 88 and is located at such a radial distance therefrom that upon rotation of the rotating plate 88, the apertures 90 will each align with the apertures 70, 72 and 74 and the elongated cavities 76 and 77 in association with the aperture 72 and 74, respectively. It will further be evident from FIGS. 12 and 13 that this radial location of apertures 90 in the rotating plate 88 is such that the apertures 90 lie beyond and do not align with the groove or passage 80, the annular cavity 82, or its enlargement 84. Hoses 92, 94 and 96 connect the apertures 70, 72 and 74 with a primary vacuum source (not shown), a secondary vacuum source (not shown) and with exhaust to the atmosphere, respectively.

It will, of course, be understood that components of the machine 10 of the present invention must be capable of easy access for purposes of cleaning, since and sanitary conditions are absolutely essential. To this end the plates 68 and 86 of the manifold 52 are normally separated when the machine 10 is not in operation to allow for access for cleaning. Accordingly, when the machine 10 is first started, an air cylinder 98, as best seen in FIGS. 1 and 2, brings the stationary and rotating plates 68 and 88 together. However, as soon as the primary and secondary vacuum sources are initiated, the face 78 of the seal member 68 of the stationary plate 66 is sealingly held against the face 86 of the rotating plate 88 and use of the air cylinder 98 may be terminated.

It will, of course, be understood that during operation of the machine 10, when the nozzle 50 of a hose 48 is engaged with the vacuum port 46 of a hood 36, its respective port 90 in the rotating plate 88 comes into engagement with the port 70 in the stationary plate 66 and face member 68. This causes a primary vacuum to evacuate the chamber 40 formed by the hood 36 and the platen 14. As the rotating plate 88 continues to rotate, the port 90 is caused to move from communication with the port 70 to communication with the elongated cavity 76 and the port 72, whereupon a secondary vacuum is drawn in the chamber 40. Continued rotation of the port 90 in the rotating plate 88 moves the port 90 from communication with the elongated cavity 76 and the port 72 to communication with the elongated cavity 77 and the port 74, whereupon the chamber 40 is devacuated or exhausted to atmosphere.

At this point, it should, perhaps, be indicated that applicants have found it desirable to utilize both primary and secondary vacuum sources for the evacuation of the chambers 40 because best results are obtained, since the initial evacuation of a chamber 40 at atmosphere will affect the evacuation of other chambers which have previously been evacuated. Accordingly, it has been found that best results are obtained when a primary vacuum source provides the initial evacuation of a chamber 40 and a secondary vacuum source subsequently maintains the vacuum within the chamber 40 during the bag clipping and sealing and trimming operations which will hereinafter be explained.

After the chamber 40 has been evacuated, the bag tail or web of the bagged product 13 is automatically gathered and a clip 100 is firmly affixed. The small amount of excess bag tail is then trimmed off and disposed of through a vacuum system 174 and associated duct 176 as will be more fully explained hereinafter.

The means in association with each chamber for applying a clip 100 to the bag 13 to close the bag 13 about the product and to trim the excess tail of the bag following clipping is best seen in FIGS. 4 and 5 and 22 through 27. The operational sequence of the clipping and trimming mechanism within the chamber 40 is shown schematically in FIGS. 14 through 17. The placement of the clip 100 itself to the bag 13 to close the bag 13 about the product is shown schematically in FIGS. 18 and 19. Finally, the operation of the clip feed mechanism is shown schematically in FIGS. 20 and 21.

Figure 25:
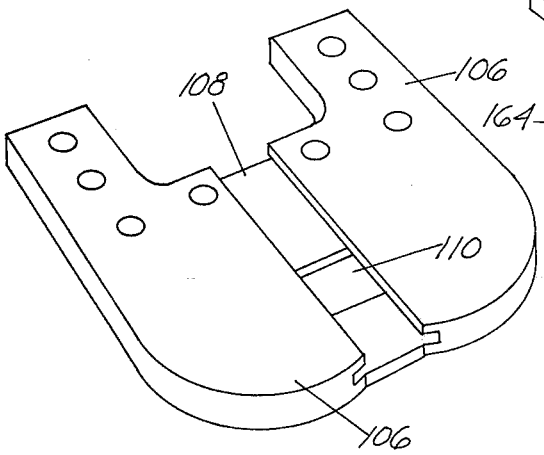
FIG. 25 is a perspective view of a clip guide showing the clip channel and clip window.
Figure 26:
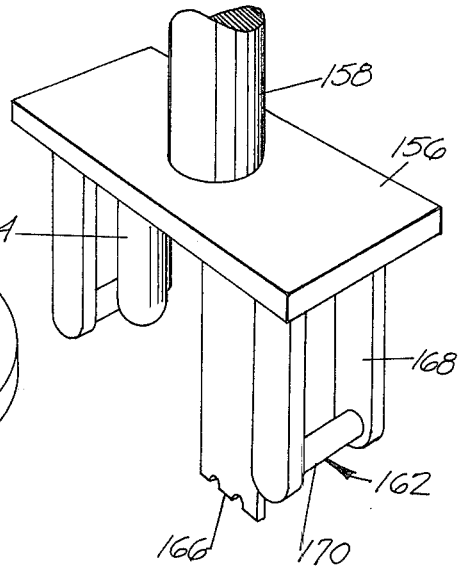
FIG. 26 is a perspective view showing the clip feed actuator, clip driver and arm drivers.
Figure 27:
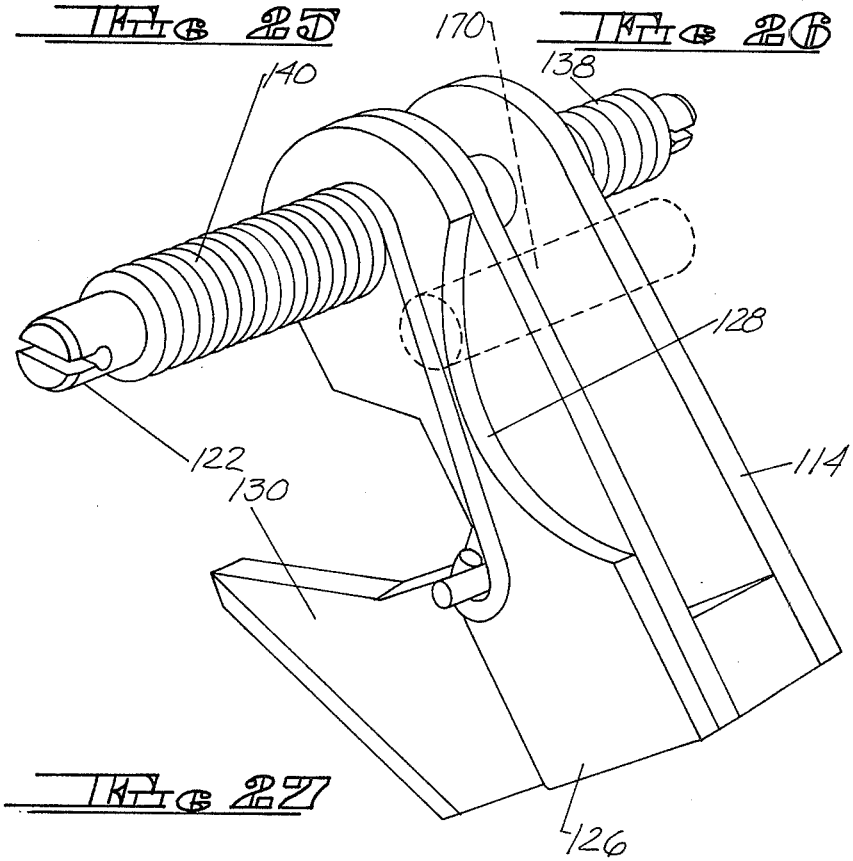
FIG. 27 is a perspective view showing gathering and cutting arms and clip die portion.

The means in association with each chamber 40 for applying a clip 100 to the bag 13 to close the bag 13 about the product and the means in association with each chamber 40 to trim the excess of the bag 13, or bag tailing, following clipping may best be described with reference to FIGS. 4, 5 and 22 through 27. There it will be seen that a mounting plate 102 secures the clipping and trimming mechanism to the underside of each hood 36. Depending from the mounting plate 102 are members 104 which carry the clip guide member 106. As best seen in FIG. 25, the clip guide member 106 is provided with an annular clip channel 108 located centrally in one side thereof. A clip window 110 extends through the other side of the clip channel member 106, intersecting the clip channel 108. The clip guide member 106 is carried by the members 104 such that the clip channel 108 is substantially vertical.

Figures 22, 23, 24:
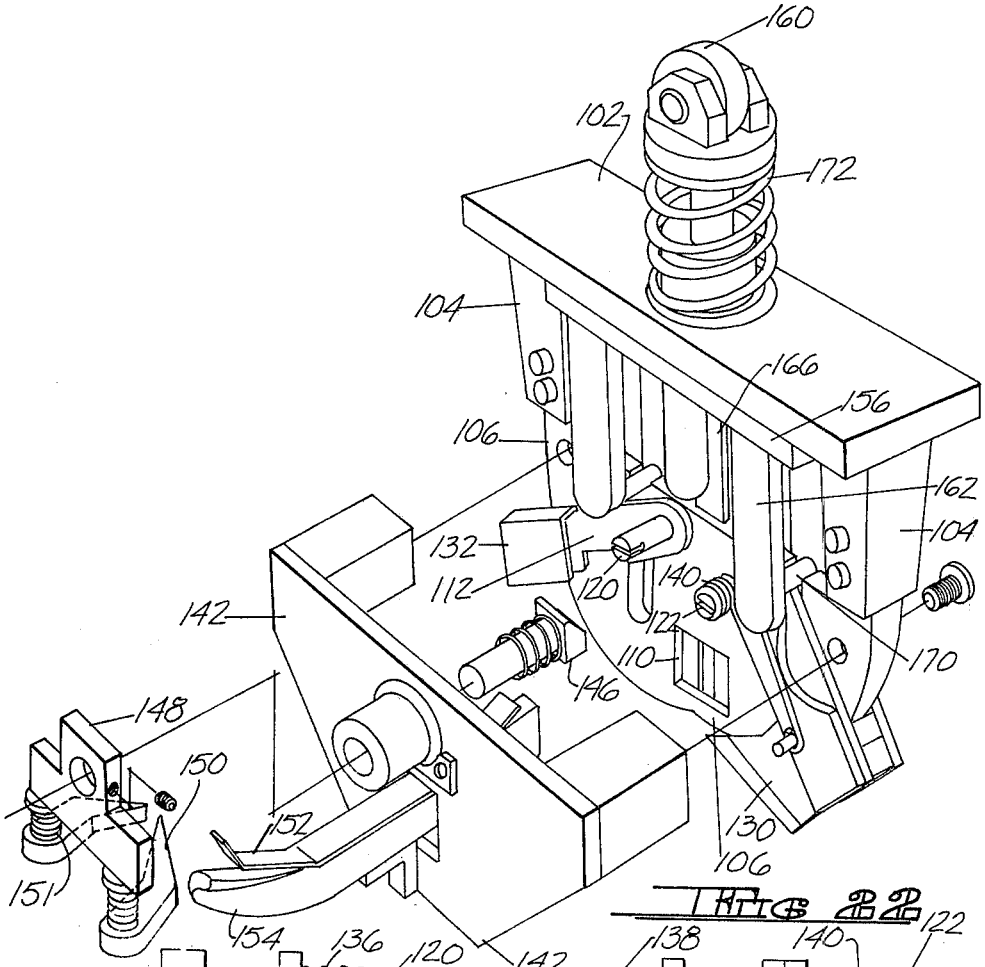
FIG. 22 is an exploded perspective view showing the clipping and trimming mechanism and the clip feed mechanism.
FIG. 23 is an enlarged front elevational view of the left gathering and cutting arm as seen from FIG. 22.
FIG. 24 is an enlarged front elevational view of the right gathering and cutting arms as seen from FIG. 22.

FIGS. 23 and 24 disclose spaced gathering arms 112 and 114. One end of each of the spaced arms 112 and 114 is provided with clip guides 116 which are centrally positioned between the spaced arms 112 and 114 by means of the spacers 118. The other ends of the spaced arms 112 and the spaced arms 114 are pivotally mounted to the pins 120 and 122, respectively. The knife arm 126 is also pivotally mounted from the pin 122 so as to pivot in juxtaposition with the spaced arms 112. It will be seen that the knife arm 126 is provided with an indentation 128 extending from one side thereof the purpose of which will be more fully explained hereinafter. As can be seen the knife arm 126 carries the knife edge 130 which is received in the sheath 132 carried by the arm 112.

The pins 120 and 122 carrying their respective gathering arms 112 and 114 and knife arm 126 are pivotally mounted in opposed fashion on the clip guide member 106, with the clip guide or channel 108 therebetween and such that the clip guide member 106 extends between the spaced arms 112 and the spaced arms 114. While the knife arm 126 pivots freely and separately from the spaced arms 114, the knife sheath 132 is secured to one of the spaced arms 112 and, therefore, pivots with the spaced arms 112. Spring members 136 and 138 on the pins 120 and 122 maintain the spaced arms 112 and 114, respectively, in the open or upwardly position away from the clip window 110 and the clip channel 108. Similarly, the spring 140 on the pin 122 maintains the knife arm 126 in the open or upwardly position away from the clip window 110.

A mounting bracket 142 secured to the clip guide member 106 carries the clip guard 152 and the clip rail 154, the spring biased clip feed cam 146 and the clip pusher bracket 148, which in turns carries the spring biased clip pusher 150. The open end of the clip feed tube 144 receives the clip guard 152 and the clip rail 154 and feeds the clips 100 positioned therein by means of the spring 156. The associated clip guard 152 and clip rail 154 guide and direct the clips 100 through the clip window 110 and into the clip guide or channel 108.

A drive unit comprising a drive plate 156 carrying a drive rod 158, one end of which in turn carries a cam roller 160, actuates the clipping and trimming mechanisms. More particularly, the drive plate 156 has depending therefrom a pair of arm drivers 162, a clip feed actuator 164 and a clip driver 166. Each of the arm drivers 162 is formed of the spaced members 168 carrying the pins 170. The drive plate 156 is mounted within the underside of a hood 36 such that the drive rod 158 extends through the hood 36. A return spring 172 maintains the cam roller in a non-actuating position. The spaced members 168 of the arm drivers 162 are spaced such that their respective gathering arms 112 and 114 and knife arm 126 fit therebetween, with the pins 170 pushing against the normally spring biased gathering arms 112 and 114 and knife arm 126. The clip driver 166 is positioned within the clip guide or channel 108 of the clip member 106. Finally, the clip feed actuator 164 is positioned such that when the drive plate 156 moves downwardly it will contact the normally spring biased clip feed cam 146.

The cam roller 160, and thus the drive rod 158 and drive plate 156 and their associated parts, are actuated by means of the clip set cam 173. An air cushion diaphragm 175 is associated with the clip set cam 173 in order to assure a constant pressure against the roller 160.

Figure 21:
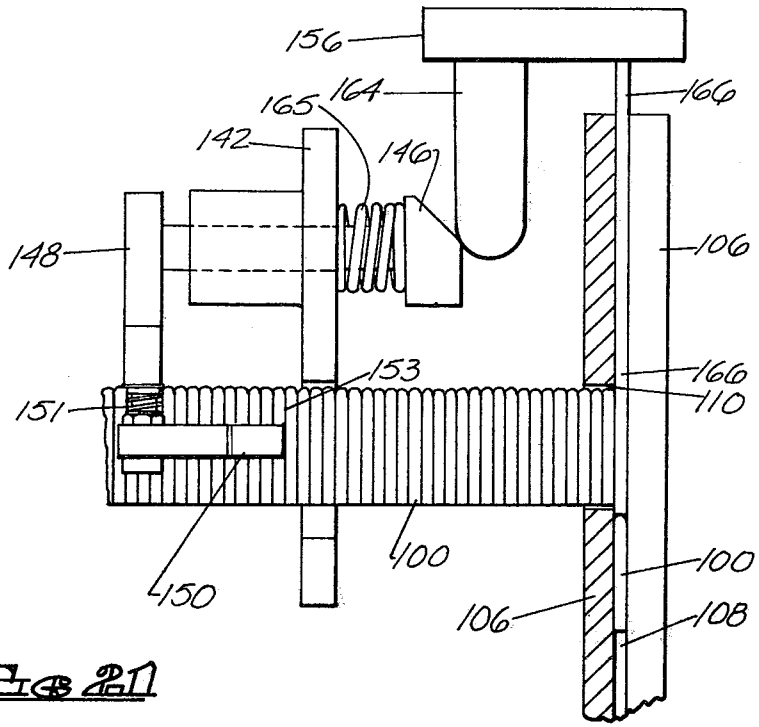
FIGS. 20 and 21 are fragmentary, schematic views, partially in section, showing the clip feed mechanism.
Figure 20:
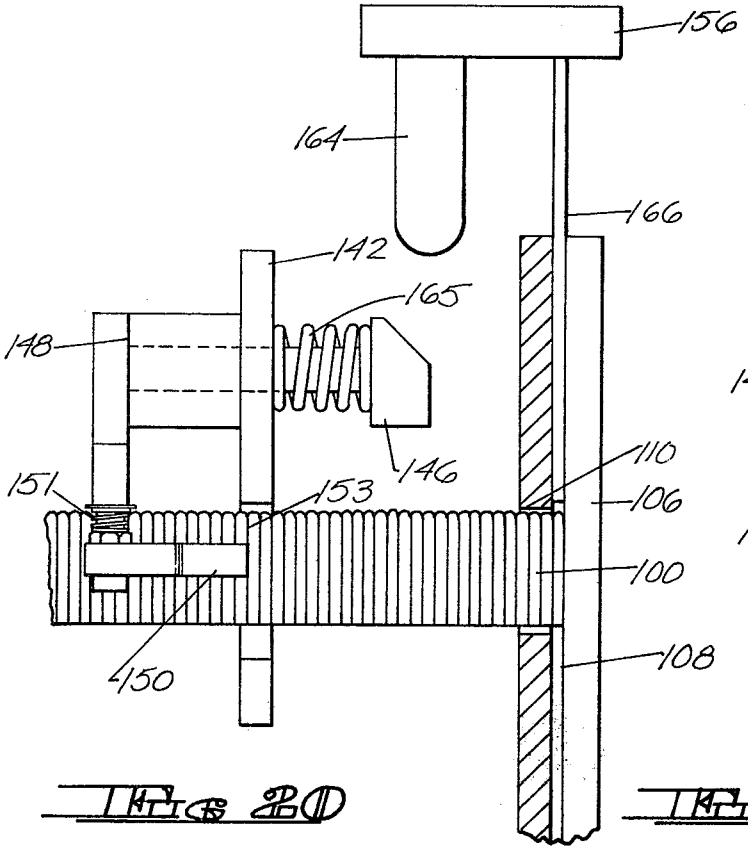

In operation, the first endless conveyor 12 moving in the directions of the arrows of FIGS. 1 and 2 moves the platens 14 and thus their respective mating hoods 36 and associated clipping and trimming mechanisms. When the chamber 40 has been satisfactorily evacuated as previously described herein, the roller 160 of the clipping and trimming mechanisms associated with its respective hood 36 is caused to move against the clip set cam 173. This causes the drive rod 158 to move downwardly against the spring 172. This action in turn moves the drive plate 156 and the associated arm drivers 162, clip feed actuator 164, and clip driver 166 in the downward direction. As best seen in FIGS. 20 and 21, when the clip feed actuator 164 moves downwardly and actuates the clip feed cam 146, it causes the clip feed cam 146 to move to the left. This causes the clip pusher bracket 148 and the clip pushers 150 to slide over the clips 100 (actually over 2 and ½ clips). The torsion spring 151 causes the clip pushers 150 to turn into the clips 100 and lodge in a crevice 153 between two adjacent clips 100. When the clip feed actuator 164 is raised the spring 165 drives the clip feed cam 146 to the right, thereby driving the clips 100 from the clip feed tube 144 into the clip window 110 and into the clip guide or channel 108 by means of the clip pushers 150 and the clip pusher bracket 148 connection just described. The clip driver 166 moving in the clip guide or channel 108 then forces the clip 100 into the cavity formed by the mating die portions 22 in the platen 14 and the clip guides 116 carried by the gathering arms 112 and 114.

Figure 14:
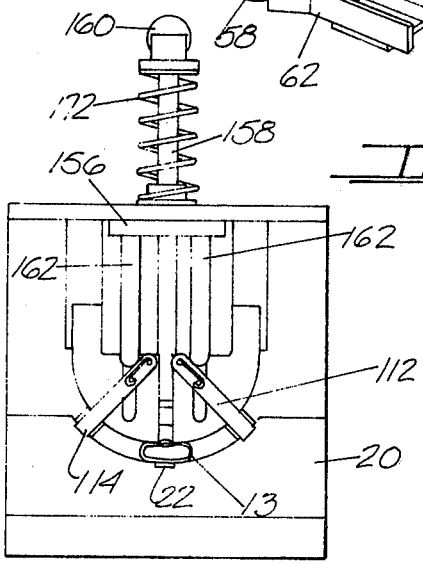
FIGS. 14 through 17 are schematic views showing the operational sequence of the clipping and trimming mechanism within a chamber formed by a mating hood and platen.
Figure 15:
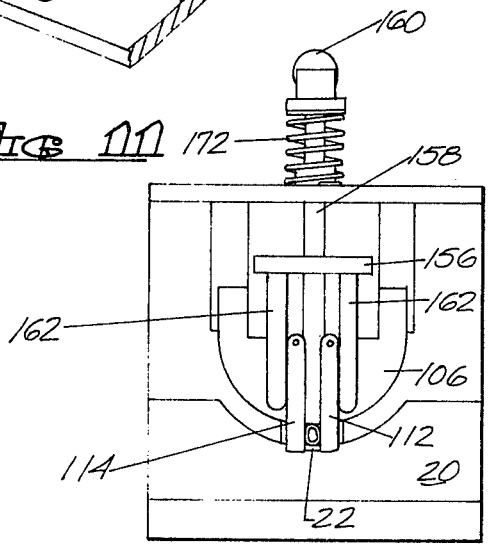
Figure 16:
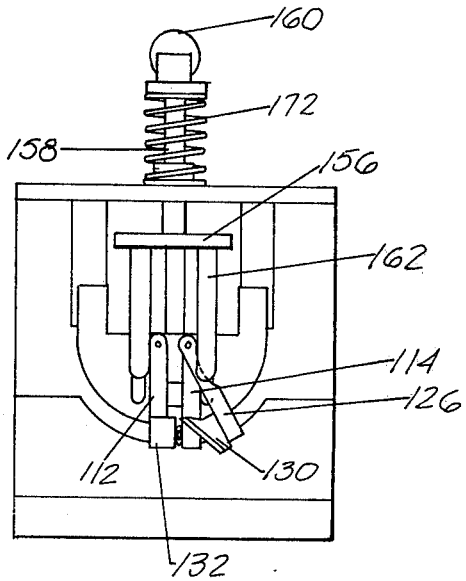
Figure 17:
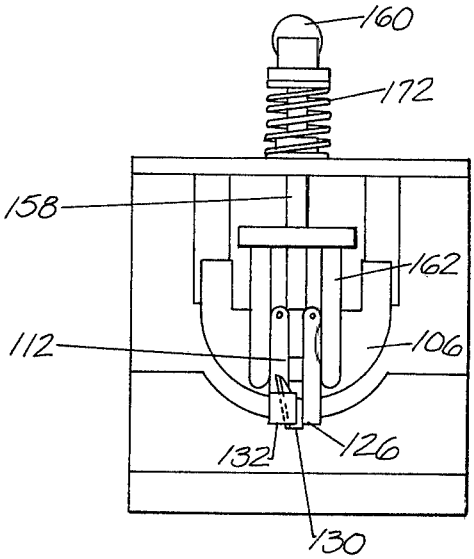
Figure 18:
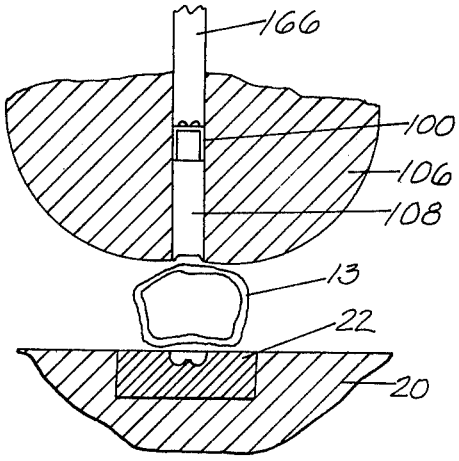
FIGS. 18 and 19 are schematic views showing the clip being placed and secured around a bag in a chamber.
Figure 19:
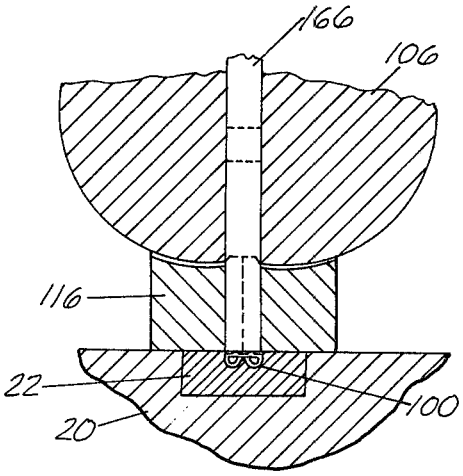

As can be seen from FIGS. 14 and 15, when the drive plate 156 moves downwardly, the arm drivers 162 and their associated pins 170 move downwardly against the gathering arms 112 and 114, causing the gathering arms 112 and 114 to move together and gather the open end of the bag 13. When the drive arms 162 have moved fully downwardly, as shown in FIG. 15, the clip guides 116 thereof align with the die 22 of the platen 14. The clip driver 166, as best seen in FIGS. 18 and 19, thereupon drives and forms the clip 100 in the cavity of the die 22. At the same time as the pins 170 of the arm drivers 162 are closing the gathering arms 112 and 114, they are also closing the knife arm 126, as best seen in FIGS. 16 and 17. It will be noted that the gathering arm 112 carries the knife sheath 132. However, this is not the case with the knife arm 126. As can be seen, the knife arm 126 is caused to follow after the gathering arm 114 because of the indentation 128. Accordingly, the gathering arms 112 and 114 fully gather the open end of the bag 13 and the clip 100 is set by the clip driver 166 in the cavity of the die 22 and clip guides 116 before the knife edge 130 carried by the arm 126 cuts off the tailing edge of the bag 13.

Following the actuation of the clipping and trimming mechanisms within the evacuated chamber 40, the port 90 of the hose 48 associated therewith is caused to traverse the exhaust port 74 in the stationary plate and seal members 66 and 68, respectively. The chamber 40 is then devacuated. The nozzle 50 is then removed from the hood vacuum port 46 prior to the lifting of or removal of the hood 36 from its respective platen 14. As the hood 36 is removed, a vacuum system 174 and associated duct 176 cause the trimmed bag tailings to be sucked up.

A suitable motor 178 may be synchronized through gearing to operate the conveyors 12, 38 and 54 along with the rotary plate 88 so that all the functions of the machine 10 will be performed in the proper sequence.

It will now be seen that the present invention provides a high speed evacuation chamber packaging and clipping machine 10 capable of obtaining the quality package which other chamber machines obtain with a much greater speed. The machine 10 of the present invention may be easily loaded, possibly automatically, and achieve a rate of up to 40 or more pieces per minute.

The hoods 36, when matched to the platens 14, form chambers 40 for the bagged product 13. The hoods 36 are each self contained with all mechanism for clipping and bag tail cut-off. The loading station for the machine 10 may be along the straight area of the conveyor 12. The product is loaded onto the machine between bag restrainers 30 and over a die holder 20 carrying a die 22 which forms the bottom clip track for a clip 100. Each hood 36 is mated automatically by the downward slope of the endless track 44 of the second conveyor 38. After each hood 36 is mated, the clipping and trimming mechanism within it is operated and restricts the neck of the bag 13 into a long narrow gap which will be the pathway for the clip 100 and the clip guides 116 and the die 22. Shortly after the hood 36 closes, a primary vacuum commences to vacuumize the chamber 40. Vacuum in the chamber 40 reaches its peak with a secondary vacuum and the clipping and trimming mechanism is actuated by the clip set cam 173. The clipping and trimming mechanism gathers the bag 13 and sets the clip 100 and performs the bag tail cut-off. The chamber 40 is then devacuumized and the hood 36 is caused to open by the upward slope of the endless track 44 of the second conveyor 38. The product 13 is discharged by the tilting platen 14 on the first endless conveyor 12. The product 13 may then be directed for further processing, such as to a film shrinking tunnel shown in U.S. Pat. No. 3,678,244 issued July 18, 1972 to Paul H. Worline. Excess bag tail is removed by blowing off with a jet of air or sucked off by a blower motor 174 and associated duct 176.

The high speed evacuation chamber packaging and clipping machine 10 of the present invention is an ideal combination or vacuum-hood air evacuation and the positive clip-seal system. It provides automation never before offered in a chamber-clipping system, since heretofore chamber clippers have been notoriously slow. The machine is designed to vacuum bag package a very wide range of products and product sizes without the necessity for time consuming and expensive machine alterations. The vacuum hood size will easily handle smoked meats, cheese and the smaller cuts of red meats up to 18 inches long, 12 inches wide, and 10 inches high, representing a very broad range of product capacity. Packaging room layout and production flow may be simplified as a result of the in-line design of the machine 10. Space is utilized to its maximum due to the fact that no expensive conveyor network is necessary for product ingress or egress. Furthermore, the in-line design of the machine 10 enables one entire end of the machine 10 to be open for easy product loading. In fact, bagged product 13 can actually readily be loaded from two sides of the machine 10.

Since there are no vacuum nozzles or fixtures to which the bagged product 13 must be attached, a minimum of excess bag length is possible, enabling the use of shorter bag lengths to save packaging cost.

Still another and very important advantage of the in-line and open end for product loading of the machine 10 of the present invention is its obvious potential for automatic product bagging and loading, since placement of bagged product 13 in the machine 10 requires only that the open bag end be placed in a "U-shaped" area of very ample size within the bag restrainers 30. Finally, the in-line design offers an important benefit to the integrity of the bagged product 13 by immediately introducing the clipped bag 13 into a hot water shrink tunnel so as to re-orient the film to its maximum gas barrier condition and to insure the quality of the clip seal.

What we claim is:

1. A high speed evacuation chamber packaging and clipping machine, which comprises a first endless conveyor carrying a plurality of bagged product carrying platens, said first conveyor conducting said platens along a horizontal path of travel with said platens facing upwardly; a second conveyor carrying a plurality of hoods, said second conveyor conducting said hoods between and along upper and lower paths of travel, said second conveyor being so located with respect to said first conveyor that when each hood is shifted from its upper path of travel to its lower path of travel it will engage one of said platens traveling in its horizontal path of travel to form a chamber therewith; means in association with each said chamber for evacuating said chamber; means in association with each said chamber for applying a clip to said bag to close said bag about said product; means in association with each said chamber to trim the excess of said bag following clipping; and means to devacuate each said chamber after said bag has been clipped and trimmed; said second conveyor being so configured that when each said hood is shifted from said lower path of travel to said upper path of travel it disenagages from its respective platen exposing said clipped and trimmed bagged product on said platen for further processing; whereby said bagged products are evacuated, clipped and trimmed continuously and in rapid succession.

2. The structure according to claim 1, wherein said means for evacuating said chambers comprises a vacuum port on the hood of each chamber, a hose for each chamber each said hose having a free end provided with a nozzle for engagement with said vacuum port, the other end of each hose being connected to a vacuum manifold connected to a vacuum source, means for inserting the free end of each said hose in its respect hood vacuum port when said hood forms a chamber with one of said platens, and means to move said nozzle from said vacuum port prior to the lifting of or removal of said hood from its respective platen.

3. The structure according to claim 2, wherein said means for inserting said nozzle of each said hose in its respective hood vacuum port when said hood forms a chamber with its respective platen comprises a third endless conveyor which conducts said nozzles along a horizontal path of travel adjacent the horizontal path of travel of said chambers formed by said mating hoods and platens, first camming means for camming each said nozzle into its respective hood vacuum port, and second camming means for camming each said nozzle out of and away from its respective hood vacuum port after the bagged product on said platen has been clipped and trimmed but prior to the lifting or removal of said hood from its respective platen.

4. The structure according to claim 2, wherein said vacuum manifold comprises a stationary plate faced with a high strength seal member, said stationary plate and facing seal member being provided with circular apertures therethrough, one of said circular apertures being in communication with a primary vacuum source, a second of said circular apertures being in communication with a secondary vacuum source, and a third of said circular apertures being in communication with atmosphere, the centers of said circular apertures being located equidistant from the center of said stationary plate, the second of said circular apertures communicating directly with a first elongated arcuate cavity formed in the surface of said facing seal member, the third of said circular apertures communicating directly with a second elongated arcuate cavity formed in the surface of said facing seal member, and a rotating plate provided with a plurality of apertures therethrough corresponding in number to the number of said vacuum hoses, each of said rotating plate apertures being equidistant from the center of said rotating plate and located at such a radial distance therefrom that upon rotation of said rotating plate, said rotating plate apertures will each align with said stationary plate and seal member apertures and said first and second elongated cavities in association with the second and third ones of said apertures, whereby as said rotating plate is rotated, the apertures thereon in association with said hoses are caused to align with the apertures through said stationary plate and facing seal member and said hoses are caused to continuously communicate in succession with said primary vacuum source, said secondary vacuum source, and said exhaust.

5. The structure according to claim 4, wherein said first elongated arcuate cavity is connected by a groove to an annular cavity formed in the surface of said seal member, said annular cavity having an enlarged portion therein said rotating plate apertures lying beyond and not in alignment with said groove, annular cavity and enlargement, whereby the forces applied to said rotating plate by said primary and secondary vacuum sources are satisfactorily distributed by means of said groove, annular cavity and enlargement.

6. The structure according to claim 5, wherein said stationary plate and said seal member may be readily separated from each other to provide easy access for cleaning.

7. The structure according to claim 6, wherein means are provided to initially hold the mating faces of said seal member and rotating plate together until said primary and secondary vacuum sources are initiated.

8. The structure according to claim 1, wherein said clipping means is mounted within each of said hoods, said clipping means comprising a mounting plate carrying a clip guide plate, said clip guide plate having an annular clip channel located centrally in one side thereof and a clip window extending through the other side thereof and intersecting said channel, said clip guide plate being carried by said mounting plate so that said clip channel is substantially vertical, a pair of spaced gathering arms one end of each said spaced gathering arm carrying a clip guide adapted to mate with the die portion carried by the other one of said spaced arms, the other ends of said spaced gathering arms being pivotally mounted on said clip guide plate so that said spaced gathering arms pivot in opposition to each other with said clip channel positioned therebetween and the spaced gathering arms on either side of said clip guide plate, said spaced gathering arms being normally biased in the open position away from said clip channel and from each other, a clip feed mechanism comprising a clip feed tube and a clip feed cam and associated clip pusher which direct clips in said clip feed tube to said clip window, and a drive plate carrying a clip feed cam actuator, gathering arm drivers and a clip driver, all depending from said drive plate such that when said driver arms actuate said spaced gathering arms toward each other and said clip channel, said clip driver is positioned in said clip channel and moves downwardly therein toward said clip window, and said clip feed actuator actuates said clip feed cam and associated clip pushers, and a die in each said platen is so positioned as to provide a bottom for said clip channel and to mate with said gathering arm clip guides to form a clip cavity, whereby when said driver plate is actuated, said clip feed actuator actuates said clip feed cam and associated clip pushers, and a clip member from said clip feed tube enters said clip window, said clip driver moves downwardly in said clip channel and said gathering arm drivers move downwardly and pivot said gathering arms toward each other, said gathering arm clip guides and said die in said platen forming a cavity in which said clip driver forms said clip about the gathered open end of the bag.

9. The structure according to claim 8, wherein said trimming means are associated with said pairs of spaced gathering arms and actuated by said spaced gathering arm drivers, said trimming means comprising a knife arm which pivots in juxtaposition with one of said spaced gathering arms, said knife arm carrying a cutting edge at one end thereof and the other of said gathering arms carrying a mating sheath at one end thereof for the receipt of said cutting edge, said knife arm being normally biased in the open position away from said clip channel.

10. The structure according to claim 9, wherein said platen die is located in an upstanding U-shaped die holder and upstanding bag restrainer arms are mounted on said platen on either side of said platen die to locate the open end of said bagged product on said platen.

11. The structure according to claim 8, wherein a driving arm carrying a cam roller on the free end thereof extends upwardly from said drive plate through said hood, and a clip set cam is positioned on said machine so as to actuate said cam roll and said drive plate as said hood is moved along said first path of travel by said first conveyor.

12. The structure according to claim 11, wherein an air cushion diaphragm is associated with said clip set cam in order to assure constant pressure against said cam roller.

13. The structure according to claim 2, wherein means are provided for disposing of the trimmed excess of said bag, said means comprising a vacuum system and associated duct.

14. The structure according to claim 1, wherein said machine is an in-line machine, said first endless conveyor passes about a pair of spaced sets of sprockets having horizontal axes, whereby to have upper and lower flights, the upper flight thereof comprising said horizontal path of travel, and said second conveyor comprises a plurality of hood supporting trolleys traveling along an endless track having a substantially oval configuration in the vertical plane so as to conduct said hoods along upper and lower flights, said lower flights constituting said lower path of travel and said upper flight constituting said upper path of travel.

15. The structure according to claim 14, wherein said means for evacuating said chambers comprises a vacuum port on the hood of each chamber, a hose for each chamber, each said hose having a free end provided with a nozzle for engagement with said vacuum port, the other end of each hose being connected to a vacuum manifold connected to a vacuum source, means for inserting the free end of each said hose in its respect hood vacuum port when said hood forms a chamber with one of said platens, and means to move said nozzle from said vacuum port prior to the lifting of or removal of said hood from its respective platen.

16. The structure according to claim 15, wherein said means for inserting said nozzle of each said hose in its respective hood vacuum port when said hood forms a chamber with its respective platen comprises a third endless conveyor which conducts said nozzles along a horizontal path of travel adjacent the horizontal path of travel of said chambers formed by said mating hoods and platens, first camming means for camming each said nozzle into its respective hood vacuum port, and second camming means for camming each said nozzle out of and away from its respective hood vacuum port after the bagged product on said platen has been clipped and trimmed but prior to the lifting or removal of said hood from its respective platen.

17. The structure according to claim 15, wherein said vacuum manifold comprises a stationary plate faced with a high strength seal member, said stationary plate and facing seal member being provided with circular apertures therethrough, one of said circular apertures being in communication with a primary vacuum source, a second of said circular apertures being in communication with a secondary vacuum source, and a third of said circular apertures being in communication with atmosphere, the centers of said circular apertures being located equidistant from the center of said stationary plate, the second of said circular apertures communicating directly with a first elongated arcuate cavity formed in the surface of said facing seal member, the third of said circular apertures communicating directly with a second elongated arcuate cavity formed in the surface of facing seal member, and a rotating plate provided with a plurality of apertures therethrough corresponding in number to the number of said vacuum hoses, each of said rotating plate apertures being equidistant from the center of said rotating plate and located at such a radial distance therefrom that upon rotation of said rotating plate, said rotating plate apertures will each align with said stationary plate and seal member apertures and said first and second elongated cavities in association with the second and third ones of said apertures, whereby as said rotating plate is rotated, the apertures thereon in association with said hoses are caused to align with the apertures through said stationary plate and facing seal member and said hoses are caused to continuously communicate in succession with said primary vacuum source, said secondary vacuum source, and said exhaust.

18. The structure according to claim 17, wherein said first elongated arcuate cavity is connected by a groove to an annular cavity formed in the surface of said seal member, said annular cavity having an enlarged portion therein said rotating plate apertures lying beyond and not in alignment with said groove, annular cavity and enlargement, whereby the forces applied to said rotating plate by said primary and secondary vacuum sources are satisfactorily distributed by means of said groove, annular cavity and enlargement.

19. The structure according to claim 18, wherein said stationary plate and said seal member may be readily separated from each other to provide easy access for cleaning.

20. The structure according to claim 19, wherein means are provided to initially hold the mating faces of said seal member and rotating plate together until said primary and secondary vacuum sources are initiated.

21. The structure according to claim 14, wherein said clipping means is mounted within each of said hoods, said clipping means comprising a mounting plate carrying a clip guide plate, said clip guide plate having an annular clip channel located centrally in one side thereof and a clip window extending through the other side thereof and intersecting said channel, said clip guide plate being carried by said mounting plate so that said clip channel is substantially vertical, a pair of spaced gathering arms one end of each said spaced gathering arm carrying a clip guide adapted to mate with the die portion carried by the other one of said spaced arms, the other ends of said spaced gathering arms being pivotally mounted on said clip guide plate so that said spaced gathering arms pivot in opposition to each other with said clip channel positioned therebetween and the spaced gathering arms on either side of said clip guide plate, said spaced gathering arms being normally biased in the open position away from said clip channel and from each other, a clip feed mechanism comprising a clip feed tube and a clip feed cam and associated clip pusher which direct clips in said clip feed tube to said clip window, and a drive plate carrying a clip feed cam actuator, gathering arm drivers and a clip driver, all depending from said drive plate such that when said driver arms actuate said spaced gathering arms toward each other and said clip channel, said clip driver is positioned in said clip channel and moves downwardly therein toward said clip window, and said clip feed actuator actuates said clip feed cam and associated clip pushers, and a die in each said platen is so positioned as to provide a bottom for said clip channel and to mate with said gathering arm clip guides to form a clip cavity, whereby when said driver plate is actuated, said clip feed actuator actuates said clip feed cam and associated clip pushers, and a clip member from said clip feed tube enters said clip window, said clip driver moves downwardly in said clip channel and said gathering arm drivers move downwardly and pivot said gathering arms toward each other, said gathering arm clip guides and said die in said platen forming a cavity in which said clip driver forms said clip about the gathered open end of the bag.

22. The structure according to claim 21, wherein said trimming means are associated with said pairs of spaced gathering arms and actuated by said spaced gathering arm drivers, said trimming means comprising a knife arm which pivots in juxtaposition with one of said spaced gathering arms, said knife arm carrying a cutting edge at one end thereof, and the other of said gathering arms carrying a mating sheath at one end thereof for receipt of said cutting edge, said knife arm being normally biased in the open position away from said clip channel.

23. The structure according to claim 22, wherein said platen die is located in an upstanding U-shaped die holder and upstanding bag restrainer arms are mounted on said platen on either side of said platen die to locate the open end of said bagged product on said platen.

24. The structure according to claim 21, wherein a driving arm carrying a cam roller on the free end thereof extends upwardly from said drive plate through said hood, and a clip set cam is positioned on said machine so as to actuate said cam roll and said drive plate as said hood is moved along said first path of travel by said first conveyor.

25. The structure according to claim 24, wherein an air cushion diaphragm is associated with said clip set cam in order to assure constant pressure against said cam roller.

26. The structure according to claim 15, wherein means are provided for disposing of the trimmed excess of said bag, said means comprising a vacuum system and associated duct.

27. A method for high speed evacuation, clipping and trimming of bagged product, continuously and in rapid succession, which comprises the steps of:

(a) providing a first endless conveyor carrying a plurality of bagged product carrying platens, said first conveyor conducting said platens along a horizontal path of travel with said platens facing upwardly;

(b) providing a second conveyor carrying a plurality of hoods, said second conveyor conducting said hoods between and along upper and lower paths of travel;

(c) locating said second conveyor with respect to said first conveyor such that when each hood is shifted from its upper path of travel to its lower path of travel it will engage one of said platens traveling in its horizontal path of travel to form a chamber therewith;

(d) evacuating each said chamber;

(e) applying a clip to said bag in each said chamber to close said bag about said product;

(f) trimming the excess of each said bag in each said chamber following the clipping of said bag;

(g) devacuating each said chamber after said bag has been clipped and trimmed; and (h) shifting said hoods from said lower path of travel to said upper path of travel so that they disengage from their respective platen, exposing said clipped and trimmed bagged product on said platen for further processing;

whereby said packaged products can be evacuated, clipped and trimmed continuously and in rapid succession.

* * * * *

UNITED STATES PATENT AND TRADEMARK OFFICE

CERTIFICATE OF CORRECTION

PATENT NO. : 4,189,897

DATED : February 26, 1980

INVENTOR(S) : Harrison A. Ailey, Jr.,L. George Andre and Roman M. Tomczak

It is certified that error appears in the above-identified patent and that said Letters Patent are hereby corrected as shown below:

[73] Assignees: Acraloc Corporation; Rheem Manufacturing Company, both of Oak Ridge, Tenn.

should read:

[73] Assignees: Acraloc Corporation, Oak Ridge, Tenn.; Rheem Manufacturing Company, New York, N.Y.; part interest each Signed and Sealed this

*Fifth* Day of *August 1980*

[SEAL]

*Attest:*

SIDNEY A. DIAMOND

*Attesting Officer*

*Commissioner of Patents and Trademarks*